United States Patent [19]

Murphy

[11] 4,343,407

[45] Aug. 10, 1982

[54] COUPLER LUBRICATING BEARING WEAR LINER CHANNEL SHAPED SUPPORT PLATE

[75] Inventor: Richard F. Murphy, Batavia, Ill.

[73] Assignee: Holland Company, Aurora, Ill.

[21] Appl. No.: 194,019

[22] Filed: Oct. 6, 1980

[51] Int. Cl.[3] ..... B61F 1/08; B61G 7/10; B61G 9/20

[52] U.S. Cl. ..... 213/51; 213/61; 213/62 R

[58] Field of Search ..... 213/51, 61, 62

[56] References Cited

U.S. PATENT DOCUMENTS

| | | | |
|---|---|---|---|
| 3,329,285 | 7/1967 | Crenshaw | 213/51 X |
| 4,055,254 | 10/1977 | Chierici et al. | 213/51 X |
| 4,059,192 | 11/1977 | Larsen | 213/51 X |
| 4,249,664 | 2/1981 | Murphy | 213/51 X |
| 4,261,472 | 4/1981 | Moore et al. | 213/51 X |

*Primary Examiner*—Robert B. Reeves
*Assistant Examiner*—Howard Beltran
*Attorney, Agent, or Firm*—McWilliams, Mann & Zummer

[57] ABSTRACT

A rigidifying arrangement for self lubricating wear plate assemblies employed for supporting the inner end of the vertical yoke used in railroad car coupler draft gear rigging, in which the wear plate is in the form of a support plate of channel shaped transverse cross section configuration having a planar web portion equipped with a special polymeric liner for supporting the yoke inner end at its operative level within the car center sill. The support plate is rigidified to maintain its planar configuration under the weight of the draft gear and yoke acting on it, by forming same to be of the indicated channel shaped configuration defining along either side edge of the plate web portion a depending flange, in which the flanges are proportioned relative to the plate web portion to provide a yoke support plate of one piece construction that is three times as strong as the conventional draft gear wear plate while being only approximately one third the weight of same.

4 Claims, 7 Drawing Figures

COUPLER LUBRICATING BEARING WEAR LINER CHANNEL SHAPED SUPPORT PLATE

This invention relates to a self lubricating wear plate arrangement for railroad car draft gear rigging yokes, and more particularly, to a rigidifying arrangement for self lubricating wear plate arrangements, for supporting the inner end of the yoke of coupler draft gear rigging, of the special type disclosed in Chierici and Murphy U.S. Pat. No. 4,055,254, the entire disclosure of which is incorporated herein by this reference.

Draft gear rigging for, for instance, AAR type F interlocking couplers conventionally comprises a draft gear applied within the center sill draft gear pocket, between pairs of stop lugs fixed to the center sill on either side of same, which pairs of stop lugs are spaced apart longitudinally of the center sill. The draft gear is embraced by a vertical yoke extending longitudinally of the car and operably connected to the coupler by a vertical connector pin that is supported by and rides on a support plate secured across the underside of the center sill and also supporting the outer end of the yoke. The inner end of the yoke is supported by and rides on a wear plate that is secured across the underside of the center sill, and it is upwardly indented to dispose the yoke inner end in proper working alignment level with the coupler longitudinally of the center sill. Additionally and conventionally, a flat safety plate is secured across the underside of the center sill between the connector pin support plate and the yoke wear plate, this safety plate normally being disposed below and spaced from the underside of the yoke.

As the draft gear operates to accommodate buff and draft impacts acting on the coupler, the yoke slides back and forth on its wear plate, which results in wear on both the wear plate and yoke that is accentuated by a downward acting vector in the forces acting on the wear plate, due to the location of the yoke wear plate at the inner end of the yoke. While the yoke wear plates are relatively easy to replace, the yokes themselves are not because of their embracing relation with the draft gear. AAR regulations require that when the yoke at its inner end has worn away about ⅜ths of an inch, the yoke must be repaired or replaced.

This required repair or replacement of the yoke necessarily involves shopping of the car for removal of the draft gear rigging and separation of the yoke from the draft gear, so that the yoke can be replaced or serviced. The worn yoke is conventionally restored to working condition by filling in its worn area with weld material, grinding down the surface involved to the needed level, and then suitably heat treating the yoke to get the repaired area of same to the required hardness. After these time consuming procedures, the yoke is then available for re-use.

The familiar AAR type E coupler draft rigging arrangement involves the familiar horizontal key connecting the yoke to the coupler, with the yoke resting on one or more wear plates secured across the underside of the center sill and either upwardly indented or built up within the center sill, to dispose the yoke in proper working alignment level with the coupler, longitudinally of the center sill. The wearing action on the yoke in these arrangements presents the same problems referred to above with regard to yoke and wear plate replacement.

In accordance with the invention of said Chierici and Murphy patent, the conventional yoke wear plate of draft rigging for AAR type interlocking couplers is replaced by a wear plate assembly comprising a planar support plate that is secured at the same position as a conventional yoke wear plate, and that is equipped with a special liner for supporting the yoke inner end at its operative level within the car center sill. The liner is formed from an ultra high molecular weight polymer material that is of dry self lubricating nature, and resists adherence thereto of foreign material. The material from which the liner is formed is also characterized by its tendency to reform the yoke underside surface portion riding on same whereby such yoke underside surface portion defines a mirror finish that acts to inhibit further wear of the yoke during use.

The liner, which may be of either plate or tubular form, is applied to the planar support plate so that the liner material is interposed between the yoke and the new support plate in question. The new wear plate assembly is equipped to have the liner centered with respect to the yoke and center sill.

Experience in service with the arrangement of said Chierici and Murphy patent revealed that the support plate on which the special liner is mounted tends to deflect out of its initial planar relation, due to the static and dynamic loads that act on it, so that the portions of the support plate between its connection to the center-sill becomes arced downwardly somewhat, so that the underside of the yoke lower strap is not in full engagement with the liner; the result is the yoke lower strap will tend to ride on the liner along the side edges of the yoke lower strap, and be spaced from the liner along the center of the yoke lower strap, thereby reducing the effectiveness of the liner both from the standpoint of the resurfacing of the lower yoke strap undersurfacing and the support of the draft gear at the desired working level alignment with the coupler.

My application Ser. No. 61,933, filed July 30, 1979, now U.S. Pat. No. 4,249,664, granted Feb. 10, 1981, discloses a rigidifying arrangement for self lubricating yoke wear plate assemblies of the type indicated, in which the liner support plate has affixed to the underside of same along the longitudinal midportion of same a depending flange structure that includes a vertically disposed flange fixed, as by employing welding, along the upper edge of same to the support plate, and a horizontal flange along its lower edge that projects normally of the vertical flange. The depending flange structure, which may be of one piece construction, is coextensive with the liner and parallels same. The results provided not only include the firm holding of the liner support plate in its desired planar relation, thereby insuring that the liner will likewise remain in its desired planar relation for effective load supporting and resurfacing action on the yoke, but also the liner support plate may be of substantially reduced gauge to perform its desired function.

The principal object of this invention is to provide a further improved rigidifying arrangement for the self lubricating yoke wear plate assembly of said Chierici and Murphy patent that effectively holds the liner support plate in its desired planar relation.

Another principal object of the invention is to effect the needed rigidifying of the self lubricating yoke wear plate assembly involved by providing the liner support plate in a one piece integral construction comprising a planar web portion and depending rigidifying flanges along either side of same arranged and proportioned to serve the same purpose as the device of my said application, but with increased strength that permits a further reduction in gauge dimensioning.

Yet another important object of the invention is to provide a yoke wear plate arrangement of the type indicated that is economical of manufacture, easy to install in both new and used equipment, and that is long lived in operation.

In accordance with the present invention, the liner support plate is in the form of a channel shaped member of integral one piece construction including a planar elongate web portion having along either side edge of same a depending flange portion, with the flange portions being of equal lengths or depth of projection from the web portion, and having a length or depth of projection from the web portion that has a ratio relative to the width of the web portion approximating one to six. The liner is centered on the improved support plate, and has a width that is approximately three-fourths the width of the support plate.

The results provided include not only the firm holding of the liner support plate in its desired planar relation, thereby insuring that the liner will likewise remain in its desired planar relation for effective load supporting and resurfacing action on the yoke, but also the liner support plate, in addition to being of one piece construction, may be of a gauge that is only seventy-five percent of that of my said Application. Thus, the improved support plate may be formed from plate stock having a gauge or thickness of three-sixteenths inch instead of a gauge or thickness of five-eighths inch that is normally employed for conventional yoke wear plates.

Other objects, uses, and advantages will be obvious or become apparent from a consideration of the following detailed description and the application drawings in which like reference numerals are employed to indicate like parts throughout the several views.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

Figure 1:
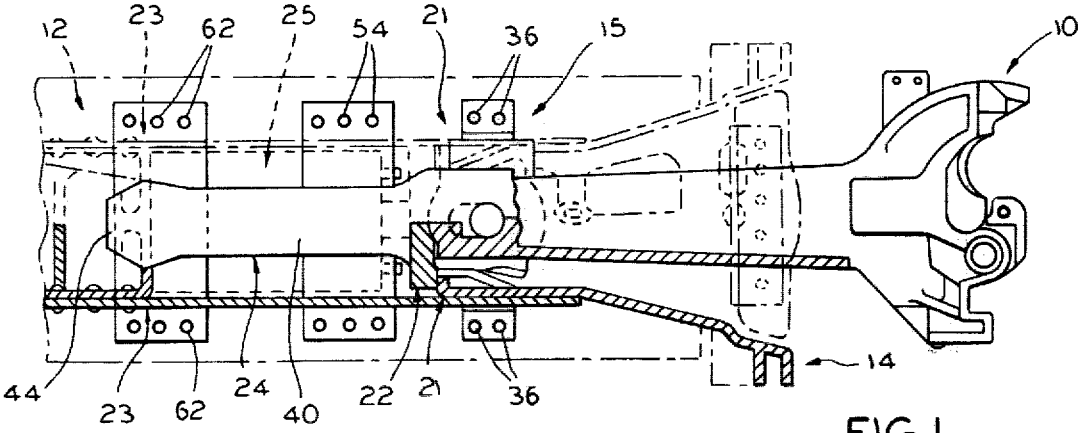
FIG. 1 is a diagrammatic plan view, partially in section, illustrating a typical mounting arrangement of an AAR type F interlocking coupler and draft rigging therefor, with parts being shown in phantom.

Reference numeral 10 of FIG. 1 generally indicates an AAR type F interlocking coupler applied to conventional center sill 12 that is an integral part of railroad car body 14 (the latter being largely omitted except for the relevant parts in the area of the operating location of the coupler 10), and mounts draft gear rigging 15.

The center sill 12 is of the usual inverted channel shape type, defining spaced side walls 16 and 16A each having laterally directed end flanges 18 and 18A, respectively.

The respective center sill side walls 16 and 16A each have applied to same, spaced apart, forward stop lugs 21 and rearward stop lugs 23 of rigging 15, defining the draft gear sprocket, between which is interposed conventional draft gear 25 and its associated front follower 22. Draft gear 25 is shown only diagrammatically as its specifics have nothing to do with the present invention.

The draft gear 25 and its front follower 22 are embraced, as is conventional, by vertical yoke 24 which is connected to the shank 26 of the coupler 10 by connector pin 28 that is supported by support plate 30 that is secured across the center sill 12, at the level of its undersides 32 and 34, by suitable rivets 36. As usual, the spherically contoured inner end 35 of the coupler 10 seats against the correspondingly contoured force transmitting recess 37 of the front follower 22.

Figure 2:
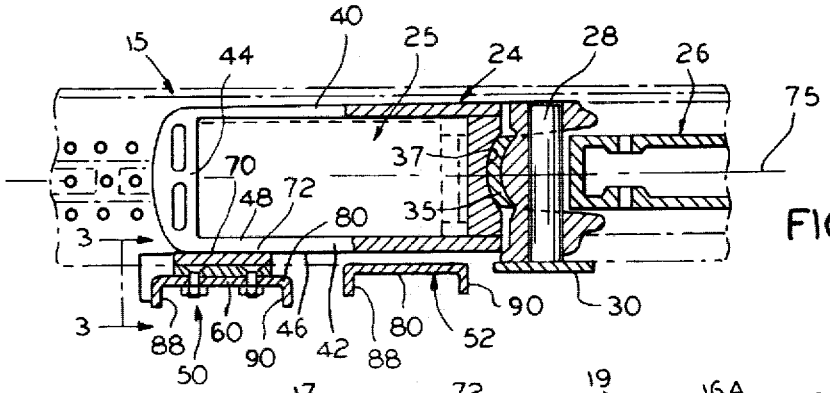
FIG. 2 is a vertical sectional view through the draft rigging and associated parts shown in FIG. 1, with parts being shown in phantom and the draft gear being shown in block diagram form, illustrating the application of the present invention thereto.
Figure 3:
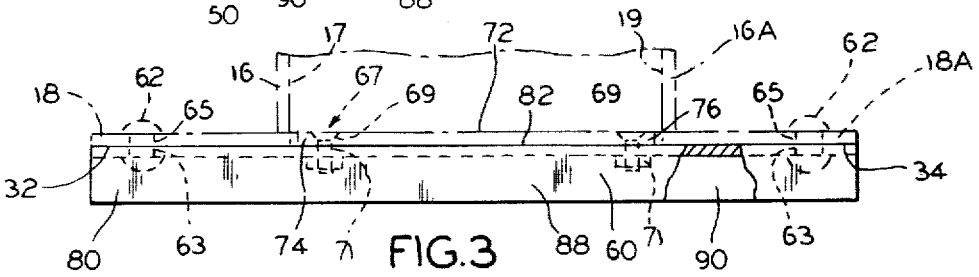
FIG. 3 is a fragmental view taken substantially along line 3—3 of FIG. 2, showing the wear plate assembly of the present invention, with the wear plate liner partially broken away, and the center sill shown in phantom.

The yoke 24 comprises the usual upper and lower straps or arms 40 and 42 that are suitably apertured as indicated in FIG. 2 to receive the connector pin 28, and that are integrally connected together at the inner end 43 of the yoke by the yoke bight portion 44.

The underside 46 of the yoke lower strap 42 is generally flat or planar in configuration, and at its inner end 48, it is supported by and rides on the conventional yoke wear plate that is replaced, in accordance with the invention of said Chierici and Murphy patent, by the yoke wear plate assembly indicated at 50 in the showing of FIGS. 1-5. Conventionally the draft gear rigging 15 involved also includes a flat safety plate (not shown) secured across the center sill 12 at the level of its undersides 32 and 34, by employing appropriate rivets 54. As indicated in FIG. 2, the safety plate is disposed below the normal working level of the yoke lower strap 42 so as to be out of contact with same, and is shown replaced by safety plate 52 that is described hereinafter.

The conventional yoke wear plate that is not illustrated is customarily secured across the center sill 12 in the same manner as plates 30 and 52, and is indented upwardly so as to dispose the yoke 24 in proper working level alignment with the coupler longitudinally of the center sill (see page 534 of the 1970 Edition of the Car and Locomotive Cyclopedia), and thus the yoke 24 is disposed in horizontal level alignment with the center line of draft, indicated at 75 in FIG. 2.

The wear plate assembly 50 in the specific form shown in FIGS. 1-5 comprises support plate 60 (the specific improvements of which are described hereinafter) that is free of the aforementioned upward indentation, and that is fixed across the center sill 12 at the level of the center sill undersides 30 and 34, as by employing suitable rivets 62 applied through aligned holes 63 and 65 formed in plate 60 and the center sill flanges 18 and 18A, respectively. Plate 60 has applied to same liner or bearing plate 64 which is of molded or extruded one piece construction and is formed from an ultra high molecular weight polymer of dry self lubricating characteristics. In the form of FIGS. 1-5, liner 64 is of plate configuration and is secured to plate 60 by employing suitable screw and nut assemblies 67 applied to the aligned holes 69 and 71 of liner 64 and plate 60 for that purpose that are located to either side of the midportion 73 of the liner 64 on which yoke 40 is to ride.

In the preferred embodiment, the polymer is the UHMW polyethylene disclosed in said U.S. Pat. No. 4,055,254, and for this application preferably has a molecular weight of at least about 3,500,000 and no greater than about 10,000,000.

Polyethylene having the ultra high molecular weight range indicated provides a liner having surfacing that is characterized by resistance to adherence thereto of foreign matter, while being self lubricating in nature and providing a coefficient of sliding or dynamic friction of the yoke surface 46 on the liner on the order of 0.20. The material in question, in addition to being a high strength wear resisting material also is characterized by effecting on the yoke surfacing riding on same a polishing or honing resurfacing action such that after a period of normal use, the yoke surfacing in question takes on a mirror-like finish whereby the wear surface of the yoke in question becomes effectively resistant against further wear. Metal worn off the yoke, during the polishing action in question, seems to embed itself in the liner wear surface, to the extent it remains in the locale of the parts involved. Any foreign matter that is caught between the two surfaces involved also seems to become embedded in the liner surfacing, and thus is positioned to avoid any wearing action on the yoke wear surface involved. As indicated, since the material from which the liner is made resists adherence thereto of foreign matter, such foreign matter does not accumulate on the liner and it is only grit and the like that becomes trapped between the two surfaces that is subject to the embedding action indicated.

Figure 4:
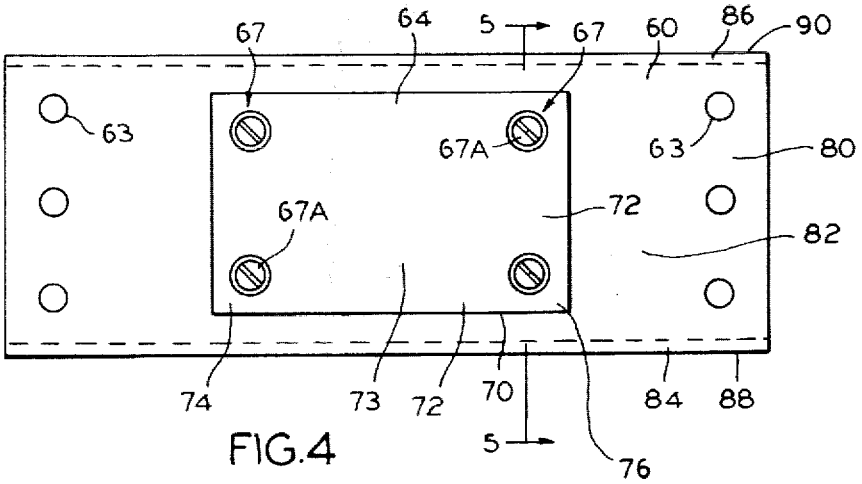
FIG. 4 is a top plan view of the wear plate assembly shown in FIG. 3.
Figure 5:
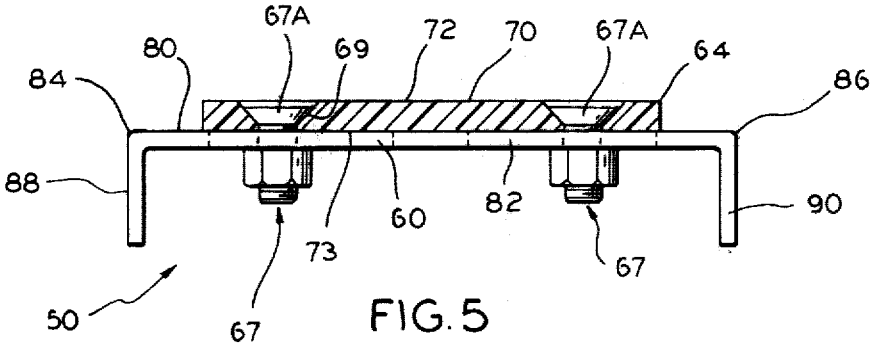
FIG. 5 is an end view of the wear plate assembly that is shown in FIG. 2, but on an enlarged scale and showing the liner in transverse section along line 5—5 of FIG. 4.

The specific liner 64 shown in the drawing Figures comprises a plate member 70 of quadrilateral configuration formed to define upwardly facing load support surface 72 on which yoke strap 42 rides and undersurface 73 (see FIGS. 5 and 6) that engages plate 60. Plate member 70 is proportioned and located on plate 60 so that its ends 74 and 76 will be closely adjacent the inner surfaces 17 and 19 of the respective center sill sides 16 and 16A, to center the liner 64 with respect to the yoke it is to support and within the confines of centersill 12. As indicated in FIGS. 2, 4 and 5, the holes 69 of plate 70 that receive the screws 67A of the screw and nut assemblies are frustoconically enlarged at their upper ends so that the heads of the screws 67A, as secured in place, will be disposed well below the load support surface 72 of plate 70 (see FIG. 5).

The plate member 70 has a thickness equivalent to that which will support the yoke inner end 48 for proper working alignment with the coupler 10 longitudinally of the center sill, which dimension is approximately ⅜ths of an inch in practicing the invention of said patent. This disposes the yoke and the draft gear it embraces in horizontal level alignment with the center line of draft (indicated at 75), in the installed relation of assembly.

In use, and as disclosed in said patent, as the coupler 10 is acted on by the usual buff and draft impacts, the draft gear 20 functions in the normal manner to absorb the impacts, which will involve the yoke 24 moving longitudinally of the cener sill inwardly and outwardly of same, which involves a sliding of the yoke undersurface 46 on the upper surface 72 of the liner 64. The invention when having the installed relation shown in the drawings acts to substantially eliminate the usual mechanical wear experienced on conventional yoke and wear plate arrangements by the dry self lubricating characteristics of the material forming the liner 64, and by the gradual forming on the yoke undersurface 48 of the aforementioned mirror-like surfacing which tests have shown to have the effect of making the metal of the yoke resistant to further wear due to relative movement with respect to the liner 64 and its support plate 60.

The wear plate assembly also serves as a sound deadener and impact energy absorber, and thus is particularly useful in the case of caboose and other cars where noise is a problem. Liner 64 avoids the metal to metal contact of conventional arrangements that are a source of much noise pollution due to the banging together of the metal parts involved.

The plate member 70 is preferably formed from molecularly oriented UHMW polyethylene, one commercially available type of which is marketed by Ketrol Enterprises of York, Pennsylvania under the trademark TUFLAR (Grade PL). This material is a high density polymer of dry self lubricating characteristics that is sufficiently compaction resistant to resist any substantial compaction under compressive forces up to its elastic limit, and has a high degree of elastic memory for full return to original free standing shape after being stressed, up to its elastic limit. This material also has a high degree of toughness and long wearing characteristics, and is also receptive to fillers in the form of glass, clay, sand, suitable fabrics, and alumina for modifying same to adapt the plate member 70 for special conditions.

As discussed hereinbefore, experience in service in practicing the invention of said Chierici and Murphy patent has revealed that the support plate (indicated by reference numeral 60 of said Chierici and Murphy patent) on which the special liner 64 is mounted tends to deflect out of its initial planar relation after a period of use, due to the static and dynamic loads that act on it through the liner plate 70, with the result that after a period of use the portion of such support plate between its connections to the center sill becomes somewhat arced downwardly. The liner 64 has sufficient flexture characteristics under the corresponding loads involved such that it conforms to the indicated arcing of such support plate, with the result that the undersurface 46 of the yoke lower strap 42 will not be in full flush engagement with the liner load support surface 72; the yoke lower strap 42 will thus tend to ride on the liner surface 72 along the side edges of the yoke lower strap 42, and be spaced from the liner load support surface 72 along the longitudinal center of the yoke lower strap 42. This reduces the effectiveness of the liner 64 both from the standpoint of the resurfacing of the lower yoke strap undersurfacing and the support of the draft gear 25 at the desired working level alignment with the coupler 10.

In accordance with the present invention, the support plate takes the form shown in the drawings of the present application at 60, and thus is in the form of a channel shaped member 80 of integral, one piece construction including a planar elongate web portion 82 having along either side edge 84 and 86 of same the respective depending rigidifying flange portions 88 and 90. The flange portions 88 and 90 are of equal lengths or depths of projection from the web portion 82 and are coextensive with the length of web portion 82.

The specific wear plate assembly 50 of the present invention involves several important proportional and sizing relationships that permit the simplified support plate 60 to be not only of one piece construction, but also have a gauge of only three-sixteenth's of an inch, as compared to the one-quarter inch gauge requirements of the corresponding support plate of my said U.S. Pat No. 4,249,664. One critical proportioning is that the length or depth of projection of the respective flange portions 88 and 90 from web portion 82 relative to the gauge of plate 80 should be in the ratio of seven to one; flange portions 88 and 90 also extend below web poriton 82 a dimension that approximates one-sixth of the width of the web portion 82 (see FIGS. 5 and 6).

In the preferred arrangement, and for best results, plate 70 is centered on channel shaped member 80, relative to its sides 84 and 86, and has a width dimension (transversely of member 80) that approximates three-fourths that of the corresponding dimension of member 80. Member 80 is formed from seven gauge (three-sixteenths inch) 8.5 pound/foot C-1020 steel and thus has a gauge or thickness that is one-half that of plate 70.

The resulting wear plate assembly 50 provides an arrangement in which the intended and initial planar shape of support plate 60, and specifically, the web portion 82 of member 80, is maintained against the static and dynamic loads imposed on the wear plate 60 when the car equipped with the assembly 50 is in service by the rigidifying action of flange portions 88 and 90. The liner 64, and thus its load support surface 72, are thus maintained in proper horizontal planar relation for full flush engagement with the undersurface 46 of the yoke lower strap 42 for insuring that the full benefits of the invention disclosed in said Chierici and Murphy patent are obtained during the useful life of assembly 50.

As indicated, another benefit provided by the assembly 50 is that support plate 60 may be of significantly reduced gauge for performing its load support functions in conjunction with the flange portions 88 and 90. Heretofore, conventional wear plates have been formed from plate stock having a gauge or thickness of five-eights of an inch. Plate 60 is formed from plate stock having a gauge or thickness of three-sixteenths of an inch with good results. Plate 60 in the form of member 80 is three times stronger and one-third lighter in weight than such conventional five-eighths inch wear plate.

While the wear plate assembly 50 illustrated is shown applied to a type F coupler application, it is equally applicable to type E coupler applications as replacements for the conventional wear plates therein employed, with like benefits to the yokes involved. The upward indenting or building up of the conventional yoke wear plates for type E coupler equipment, which is similar in amount to that required for type F equipment is thus avoided by doing the proper positioning of the yoke with the indicated thickness of the liner.

It is also preferred that the conventional safety plate (not shown) of the draft gear rigging be replaced by providing a second channel member 80 in its place that forms safety plate 52, as shown in FIGS. 1 and 2, which, as already indicated, is secured in place by employing suitable rivets 54. This second member 80 is the same as the member 80 of assembly 50, put lacking liner 64.

Figure 6:
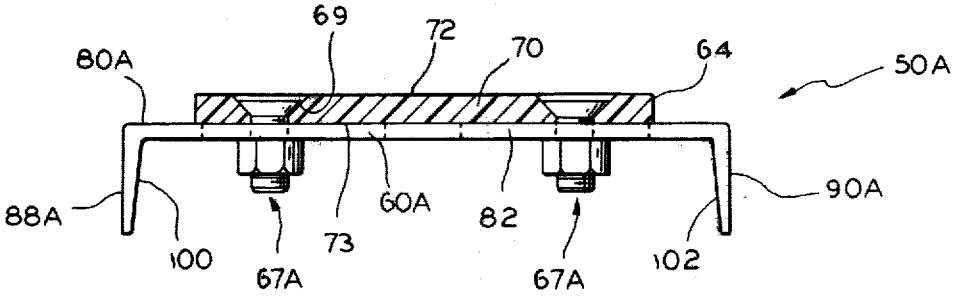
FIG. 6 is a view similar to that of FIG. 5 but illustrating a modified form of the invention.

FIG. 6 illustrates a modified wear plate assembly 50A that includes bearing plate member 70 of assembly 50, in which the channel member 80A forming support plate 60A is formed from 8.5 pound per foot rolled stock of nominal seven gauge C-1020 steel. Flange portions 88A and 90A on their inside surfaces 100 and 102 have a two degree taper, as indicated; assembly 50A is otherwise the same as assembly 50, as indicated by corresponding reference numerals.

Figure 7:
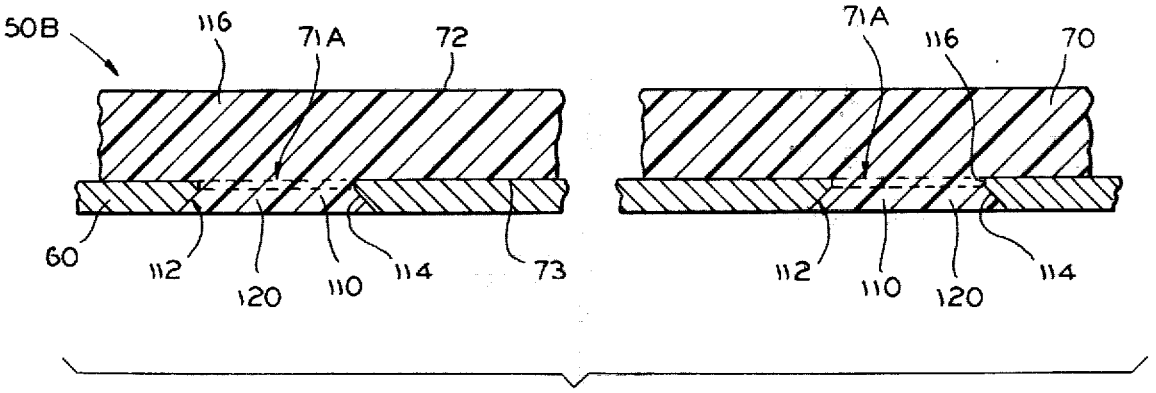
FIG. 7 is a fragmental sectional view illustrating another embodiment of the invention, viewed as taken along line 5—5 of FIG. 4, but on an enlarged scale and showing both the liner and its support plate in vertical section, at the location of the modified securement of the liner to its support plate.

In FIG. 7, another wear plate assembly 50B is diagrammatically illustrated that includes the plate member 70 and its support plate 60, in which these components are secured together employing the spin welding techniques of Osvaldo F. Chierici patent application Ser. No. 139,439, filed Apr. 11, 1980 (the disclosure of which is incorporated herein by this reference), which is assigned to same assignee as that of the instant Application. In this embodiment, the screw and nut assemblies 67 are eliminated, as is the need to form openings 69 in plate 70. The holes 71A of the support plate 60 may be four in number suitably located in the pattern suggested by holes 71 and shaped to receive a disc 110 formed from the same polymeric material as plate member 70 and spun welded in place so as to become integrally united with plate member 70, in interlocking relation to plate 60 as indicated by FIG. 7, and in accordance with the teachings of said Chierici Application Ser. No. 139,439.

For this purpose, holes 71A are in the form of circular apertures 112 of circular outline that each include a frusto-conical portion 114 that extends through a substantial portion of the thickness of plate 60 and merges into a short cylindrical portion 116 that is on the side of plate 60 against which plate member 70 is to be applied. The disc 110 that is applied to each aperture 112 is initially cylindrical in configuration and has an external diameter equivalent to the diameter of the aperture cylindrical portions 116 and has a thickness somewhat exceeding that of the plate 60. The disc 110 for each aperture 112 is disposed in portion 116 of same, with plate member 70 seated on its surface 72 on a suitable fixed horizontal surface with the plate 60 disposed on top of same (against surface 73) in centered relation thereto (as may be insured by a work table arrangement of the type disclosed in said Chierici Application), with the orientation of FIGS. 4 and 5, and pressed against the intended undersurface 73 of plate member 70 while being rotated as disclosed in said Chierici Application, with the polymeric material at the interface between the disc 110 and the plate member 70 heating up under the friction involved to the extent that along the interface involved the polymeric material fluidizes to the configuration and integral nature illustrated whereby, on cooling the discs 110 become integral flat studs 120 that anchor the plate member 70 to support plate 60, and are of one piece construction with plate member 70 and in interlocking relation with plate 60, as shown in FIG. 7.

In connection with the embodiment of FIG. 7, only two spaced apart fastenings of the plate member 70 to plate 60, as represented by studs 120, may be employed, as desired, which may be located in any suitable orientation, such as being aligned with either the transverse or longitudinal centerlines of the plates 60 and 70, in centered relation to plate member 70.

It will therefore be seen that the invention provides a wear plate assembly for draft gear rigging yokes which is not only of simplified nature and has the capability of eliminating the hereinbefore mentioned wear problem on the yoke and its wear plate, but also avoids the deflection of support plate 60 while permitting plate 60 to be formed from relatively thin gauge stock with increased strength while providing for weight reductions.

The invention is equally applicable to new and old equipment, and when applied, not only provides for a dry self lubricating type action, but also a resurfacing of the yoke undersurface which results in both the yoke and its wear plate assembly being protected against undue wear following the disclosure of said patent. As the material from which the liner of the invention is made resists adherence thereto of foreign material, the abrasive effect of foreign matter that is usually found in equipment of this type, especially where wet type lubricants are employed, will be largely avoided, with any trapped foreign matter becoming embedded in the liner. The term "foreign matter" in this regard means the dirt, grit, dust, road bed particles and the like that under the car equipment is exposed to in service, as is well known in the art.

The invention in providing assemblies 50, 50A and 50B, and the use of members 80 as the rigging safety plate also permit approximately thirty-five pounds in weight to be eliminated from each end of the car in the area of the draft gear pocket. This contributes to savings of locomotive fuel where the train is made up of a number of freight cars equipped in accordance with this invention.

Furthermore, the liner, when the car is operating, absorbs the energy of impacts against it due to yoke movements relative to it, and in avoiding metal to metal contact between the yoke and its wear plate, also acts as a sound deadener.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a draft gear rigging for railroad cars having a channel shaped center sill opening downwardly and extending longitudinally of the car, with the rigging mounted at the end of the car and comprising a draft gear applied between stops spaced longitudinally of the car and within the center sill and defining the draft gear pocket, which draft gear is embraced by a vertical yoke within the draft gear pocket and extending longitudinally of the car and operably connected to the car coupler, with the yoke comprising upper and lower straps, with the yoke being supported by its lower strap riding on a support plate assembly secured at its ends at the underside of the center sill, said support plate assembly including a generally planar support plate underlying the draft gear pocket and extending crosswise of and being substantially coplanar with the underside of the center sill, and a liner formed from a polymer of dry self lubricating characteristics and aligned with the draft gear pocket and interposed between the support plate upper side and the yoke lower strap underside and forming a bearing surface on which the yoke lower strap inner end rides to dispose the yoke at its operative level within the center sill.

the improvement wherein said support plate is of light gauge steel and of channel shaped transverse cross-sectional configuration defining a planar web portion separating a pair of depending rigidifying side flanges that extend longitudinally of said plate and are integral and coextensive with same, said plate being of one piece construction and of substantially uniform gauge along the length of its said web portion, said plate having its respective ends secured to the centersill underside in transverse relation to the centersill to secure the support plate assembly to the centersill with said plate web portion top surface being substantially coplanar with the underside of the centersill, with the liner being centered on said plate between said rigidfying flanges, said rigidfying flanges depending below said plate web portion a dimension that rigidfies said plate web portion, said liner having a width that is slightly smaller than the width dimension of said plate web portion.

2. The improvement set forth in claim 1 wherein:

said plate gauge approximates one-half the thickness of the liner.

3. The improvement set forth in claim 1 wherein:

said liner is secured to said plate web portion by nut and bolt assemblies that are recessed below said bearing surface.

4. The improvement set forth in claim 1 wherein:

said bearing surface is continuous across said liner, said liner being anchored to said plate by a plurality of studs each extending through a correspondingly located aperture of said plate web portion and integral with and interlocked with said plate web portion.

* * * * *